US006826797B1

(12) United States Patent
Chenvainu et al.

(10) Patent No.: US 6,826,797 B1
(45) Date of Patent: Dec. 7, 2004

(54) ORAL DEVICES

(75) Inventors: Alexander T. Chenvainu, Brookline, MA (US); Thomas A. Christman, Lexington, MA (US); Amit Birla, Mansfield, MA (US)

(73) Assignee: Gillette Canada Company, Halifax ( * ) Notice: Subject to any disclaimer, the term of this patent is extended or adjusted under 35 U.S.C. 154(b) by 0 days.

(21) Appl. No.: 09/573,576

(22) Filed: May 18, 2000

(51) Int. Cl.[7] ..... A46B 7/10; A46B 9/04; A61H 13/00

(52) U.S. Cl. ..... 15/110; 15/27; 15/167.1; 15/188; 601/141

(58) Field of Search ..... 15/27, 106, 110, 15/167.1, 188; 132/309; 601/139, 141, 119, 122, 123, 125; D4/104, 108, 109; D24/211, 214

(56) References Cited

U.S. PATENT DOCUMENTS

| | | | | | |
|---|---|---|---|---|---|
| 1,091,090 | A | * | 3/1914 | Tacail | 601/141 |
| 1,153,409 | A | * | 9/1915 | Wheeler | 601/141 |
| 1,544,404 | A | * | 6/1925 | Hummel | 15/167.1 X |
| 1,693,229 | A | | 11/1928 | Felmar | 15/167.1 |
| 1,758,632 | A | | 5/1930 | Wagner | 15/167.1 |
| 1,872,832 | A | * | 8/1932 | Silverberg | 601/141 |
| 2,175,975 | A | * | 10/1939 | Steiner | 15/27 X |
| 2,193,249 | A | * | 3/1940 | Flanders et al. | 601/123 |
| 2,220,053 | A | * | 10/1940 | Pruner | 15/27 |
| 2,246,867 | A | | 6/1941 | Thomas et al. | 15/110 |
| 2,653,598 | A | * | 9/1953 | Torino | 601/141 |
| 4,268,933 | A | * | 5/1981 | Papas | 15/167.1 |
| 4,744,350 | A | * | 5/1988 | Sato | 601/119 |
| 5,040,260 | A | | 8/1991 | Michaels | 15/167.1 |
| 6,389,634 | B1 | * | 5/2002 | Devlin et al. | 15/110 |

FOREIGN PATENT DOCUMENTS

| | | | | |
|---|---|---|---|---|
| BE | 894944 | | 1/1983 | |
| DE | 571724 | * | 3/1933 | 15/188 |
| DE | 1112966 | * | 8/1961 | |
| FR | 829086 | | 10/1938 | |
| GB | 2214420 | | 6/1989 | |
| IT | 59230 | | 4/1959 | |

OTHER PUBLICATIONS

Derwent Acc No 1998–411829, abstracted pubo RU 2100001C, published Dec. 27, 1997.*

* cited by examiner

*Primary Examiner*—Mark Spisich
(74) *Attorney, Agent, or Firm*—Fish & Richardson P.C.

(57) ABSTRACT

Oral devices are provided, including oral brushes that include bristle tufts and a rotatable member having radially extending protrusions constructed to wedge between a user's teeth and, among other things, cause compression of the papilla.

24 Claims, 13 Drawing Sheets

ORAL DEVICES

BACKGROUND

The present invention relates to oral devices, e.g., oral brushes. Related subject matter is disclosed in commonly assigned application Ser. Nos. 09/199,122 (abandoned) and 09/421,747(U.S. Pat. No. 6,389,634), filed on Nov. 24, 1998 and Oct. 20, 1999, respectively.

Conventional toothbrushes, having tufts of bristles mounted on a head, are generally effective at removing plaque from the flat surfaces of teeth and the areas between teeth and along the gumline that can be accessed by the bristles. However, such toothbrushes typically cannot clean interproximal and sub-gingival areas where tufts of bristles are unable to penetrate or reach. This is because the bristles tend to pass or flick over the gaps between the teeth and are usually physically impeded from reaching behind the interdental papillae and below the gumline. To clean these areas (col and sub-gingival areas), it is generally necessary to floss between the teeth with dental floss.

While flossing effectively cleans the supra-gingival and sub-gingival regions between teeth, many people do not floss regularly. Failing to floss regularly may result in gingivitis, which can lead to more serious gum diseases. These problems can occur despite regular toothbrushing.

SUMMARY

The invention features oral devices, such as oral brushes, that are capable of providing interproximal and sub-gingival cleaning and/or gingival stimulation by compression of the papilla during brushing of the teeth. The term "interproximal" refers to the areas between the teeth of a mammal. It is believed that these oral brushes provide clinical benefits, e.g., reduction of gingivitis, to users who do not floss regularly but who do use the oral brush regularly, relative to the benefits provided by using a conventional toothbrush with the same regularity without flossing.

In one aspect, the invention features an oral brush that includes a body having a head that is shaped for insertion into the oral cavity, tooth cleansing elements extending from a top surface of the head, and one or more rotatable elements, mounted on the head, including a central portion and a plurality of protrusions extending radially from the central portion, each protrusion having a double-taper, tapering from a relatively wide base to a relatively narrow tip.

Preferred embodiments of the invention include one or more of the following features:

The rotatable element is mounted to rotate about an axis that is substantially parallel to the top surface of the head. The head may include a slot positioned to allow the rotatable element to rotate freely. The dimensions of the rotatable element, and the number of protrusions, are selected so that the tips are circumferentially spaced at intervals that correspond approximately to the average spacing of human teeth. The tips define a circle or a hemisphere. The tips are shaped and sized to penetrate the interproximal regions of the oral cavity. In one embodiment, the plurality of protrusions are generally diamond-shaped in cross section.

The protrusions are sized to wedge into the interproximal spaces and compress the papilla. In one embodiment, the tips have a width of less than 0.080 inch, more preferably less than 0.05 inch, and most preferably from about 0.005 to 0.030 inch. The tips have a height of less than 0.100 inches, more preferably from about 0.005 to 0.060 inches. The length of the protrusions is preferably 0.15 to 0.20 inches. The tips are formed of a material having a durometer reading from 25 to 85 Shore A, more preferably about 55 to 75 Shore A.

The tooth cleansing elements may be elongated elastomeric members, but may also be made from bristles.

The oral brush may include two rotatable elements, or more. Each rotatable element may be mounted to rotate about an axis of rotation that is substantially parallel to the top surface of the head or mounted about an axis angled to the top surface of the head. The axes of rotation of multiple rotating elements may or may not be collinear. In embodiments that mount multiple rotatable members in a non-collinear manner, the angle formed between the rotatable elements may be from 0 to 45 degrees. The rotatable members may be positioned at or near the end of the head.

In another aspect, the invention features an oral brush that includes a body having a head shaped for insertion into the oral cavity, tooth cleansing elements extending from a top surface of the head, and a pair of rotatable elements, each rotatable element including (a) a central portion that is mounted on the head to rotate about an axis of rotation, and (b) a plurality of protrusions extending radially at spaced intervals about the circumference of the central portion, each protrusion having a tip that is shaped to penetrate the interproximal region of the oral cavity, the rotatable elements being mounted so that the axes of rotation are not collinear. In this embodiment, each protrusion preferably defines a generally triangular-shaped cross section.

In another aspect, the invention features an oral brush that includes a body having a head shaped for insertion into the oral cavity, tooth cleansing elements extending from a top surface of the head, and a rotatable element mounted on the head, which includes a central portion and a plurality of protrusions extending radially from the central portion, each protrusion being shaped to wedge between a users teeth, resulting in compression of the papilla.

Preferred embodiments include one or more of the following features. The protrusions are either solid tapered members or tufts of bristles. The protrusions are shaped to penetrate the interproximal area. The axes of rotation define a plane that is substantially parallel to the top surface of the head. The ends of the tips of each rotatable member define a generally diamond shape. When two or more rotatable members are used, the tips of each rotating member define a generally triangular shape.

The invention also features an oral care device that includes a body having a head shaped for insertion into the oral cavity, and a rotatable element mounted on the head. The rotatable element includes one or more of the features described above. Further, the invention may feature an oral care device that includes a body having a head shaped for insertion into the oral cavity at a first end of the body, tooth cleansing elements extending from a top surface of the head, and a rotatable element mounted proximate a second end of the body, opposite the end where the head is located.

In another aspect, the invention features methods of cleansing the interproximal regions of the oral cavity using an oral brush of the invention.

Other features and advantages will become apparent from the following Detailed Description, the drawings and the claims.

DETAILED DESCRIPTION

Figure 1:
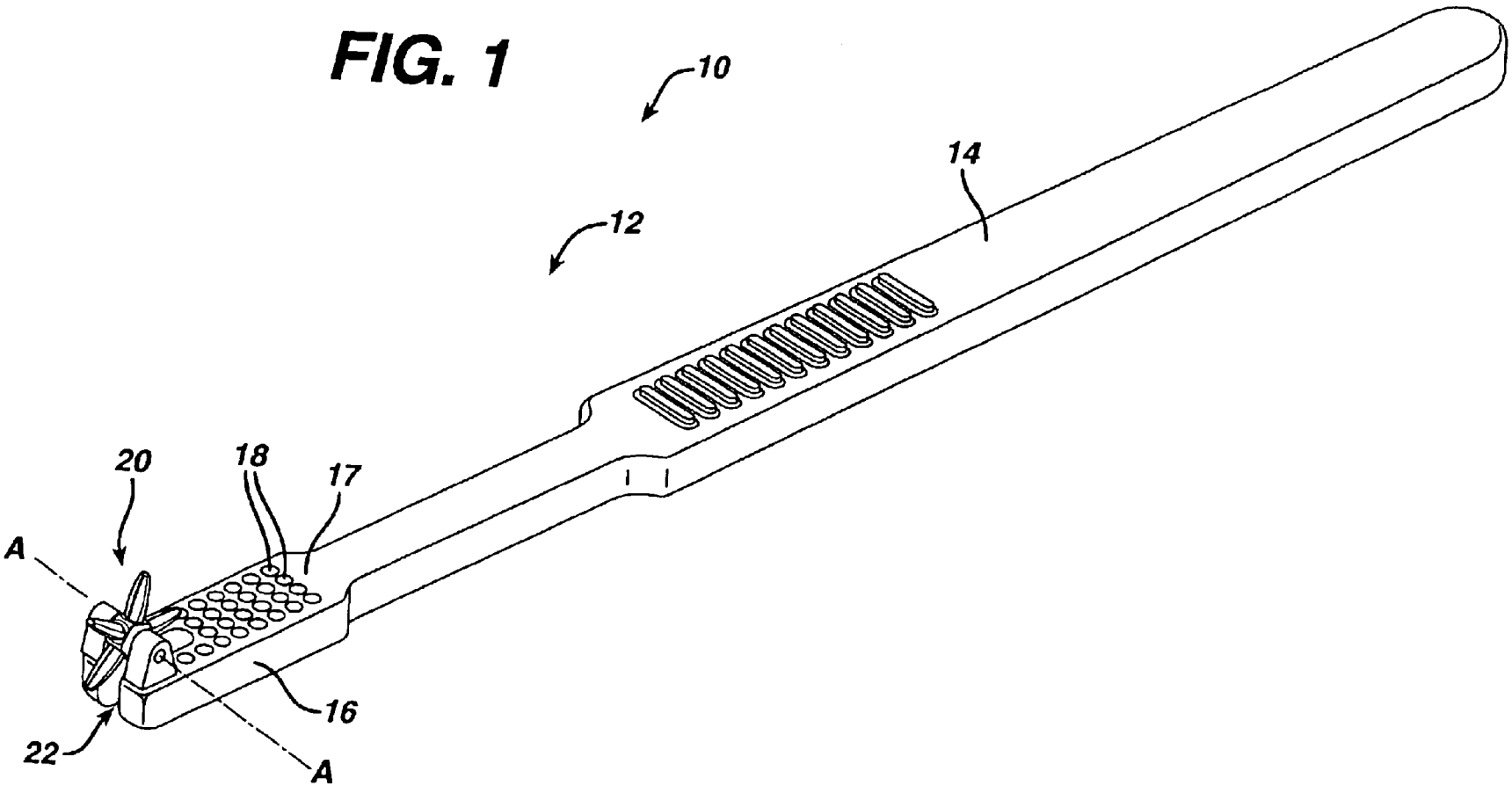
FIG. 1 is a perspective view of an oral brush according to one embodiment of the invention.
Figure 1A:
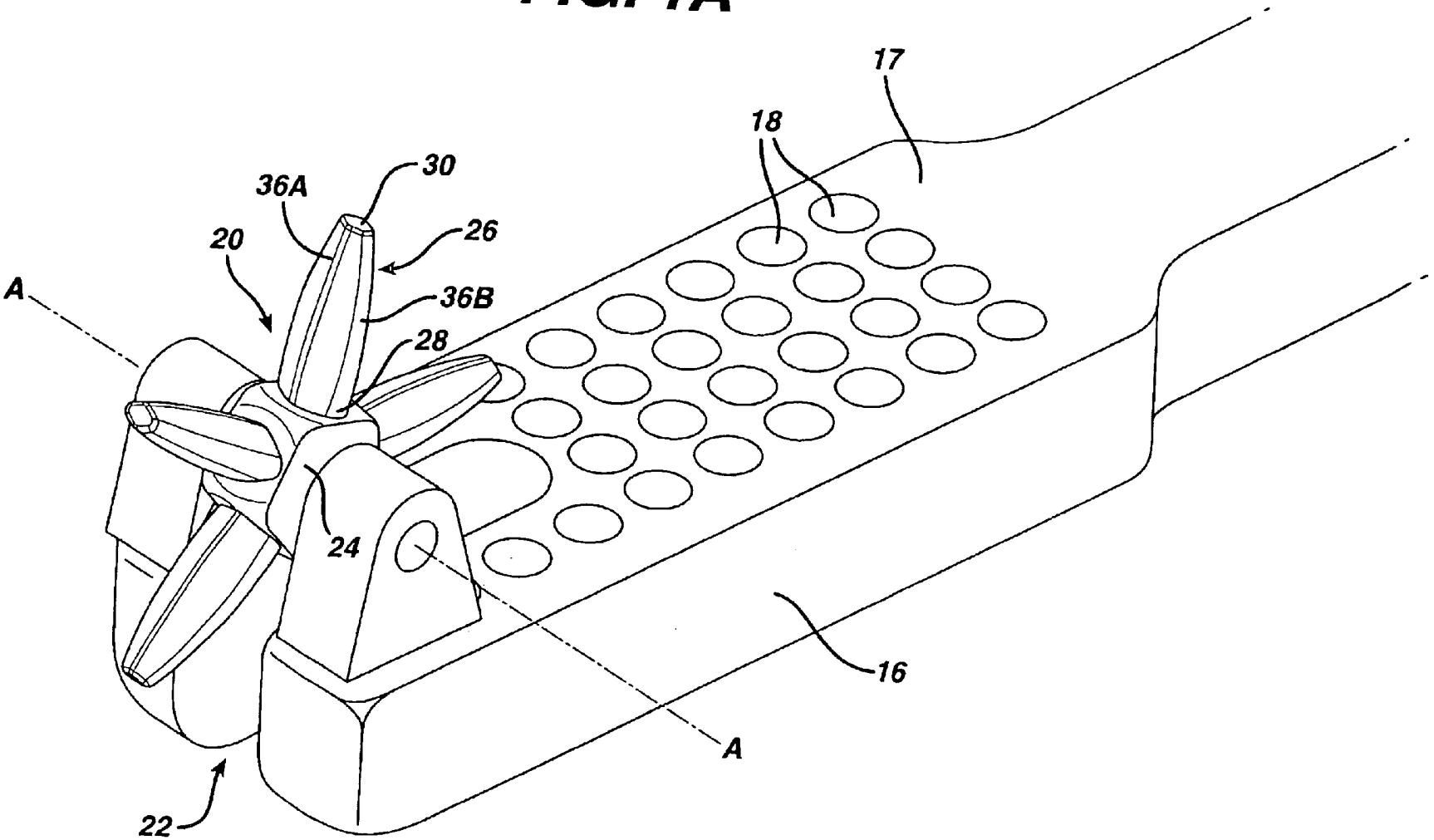
FIG. 1A is an enlarged detail view of the head of the oral brush of FIG. 1. Bristle tufts are omitted in these figures, for clarity.

Referring to FIG. 1, an oral brush 10 includes a body 12 that defines a handle 14 and a head 16. Head 16 includes a top surface 17 having a plurality of apertures 18 that are constructed to receive tooth cleansing elements, e.g., tufts of bristles (not shown). A wheel 20 is mounted proximate an end of the head 16, for rotation about an axis A. As shown in FIG. 1A, head 16 includes a slot 22, extending through the thickness of the head in the area of the wheel 20, to allow the wheel 20 to spin freely about axis A.

Referring to FIG. 1A, the wheel 20 includes a central hub 24 and, extending radially from the hub, a plurality of double-tapered members 26. Each member 26 is substantially diamond-shaped in cross-section, and tapers in two dimensions, from a relatively wider, base 28 to a tip 30. Thus, both the height and the width of each member decrease along the length of the member from the base to the tip. This "double-taper" provides the member with angled side surfaces 36, which are able to wedge between the teeth and stimulate the gums in much the same manner as a toothpick. The rate of decrease in height and width varies so as to form a curve along the members 26 (as shown), or it can be constant. Preferably, the decrease in height and width is substantially continuous, as shown. However, if desired the double-taper may extend from the tip to a point spaced from the base, e.g., 0.010 inches or less from the base, since generally the full length of the member will not be inserted between the teeth. Surfaces 36A and 36B (the interface between sides 36) are rounded, such as fillets, so the interface between adjacent sides 36 of the diamond-shaped cross section do not create a sharp edge that could irritate the gums. The preferred geometry of the members will be discussed in more detail below, with reference to FIGS. 2 and 2A.

During brushing of the teeth using a back-and-forth movement the wheel 20 rotates about axis A. Because the members 26 are diamond-shaped in cross-section, and taper to a wider base 28, as the wheel rotates the tips 30 and a portion of the members 26 wedge between the teeth into the interproximal regions to remove food and debris. The amount of penetration of the member 26 will depend on the dimensions of the member 26, particularly the taper angle, and the user's interproximal spacing. The side surfaces 36*b* (FIG. 2A) of each member 26 will also contact the gums, resulting in cleaning and/or massaging of the supragingival area and compression of the papilla.

Figure 2:
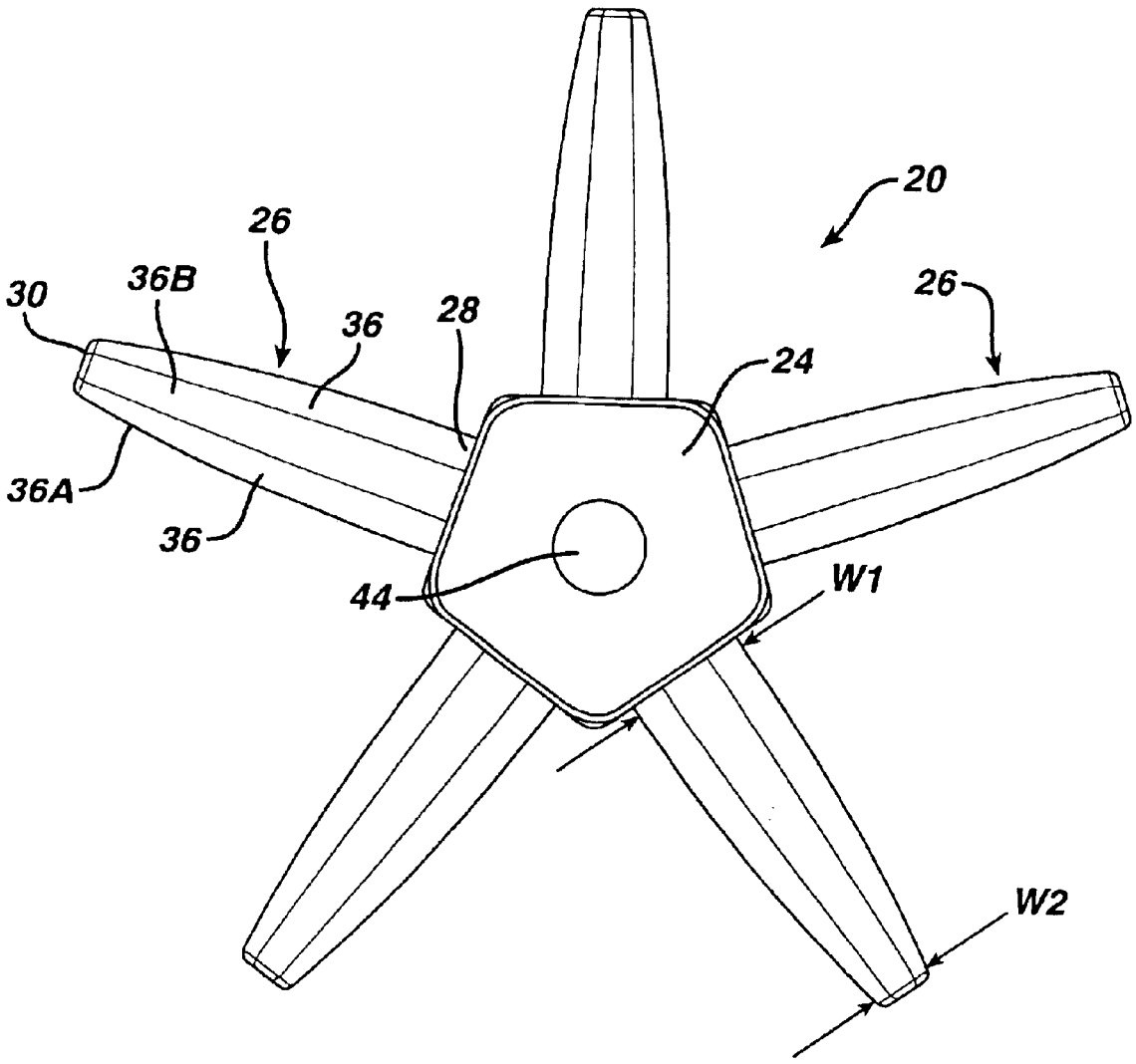
FIGS. 2 and 2A are, respectively, a front plan view and a perspective view of the rotatable element of the oral brush of FIG. 1.
Figure 2A:
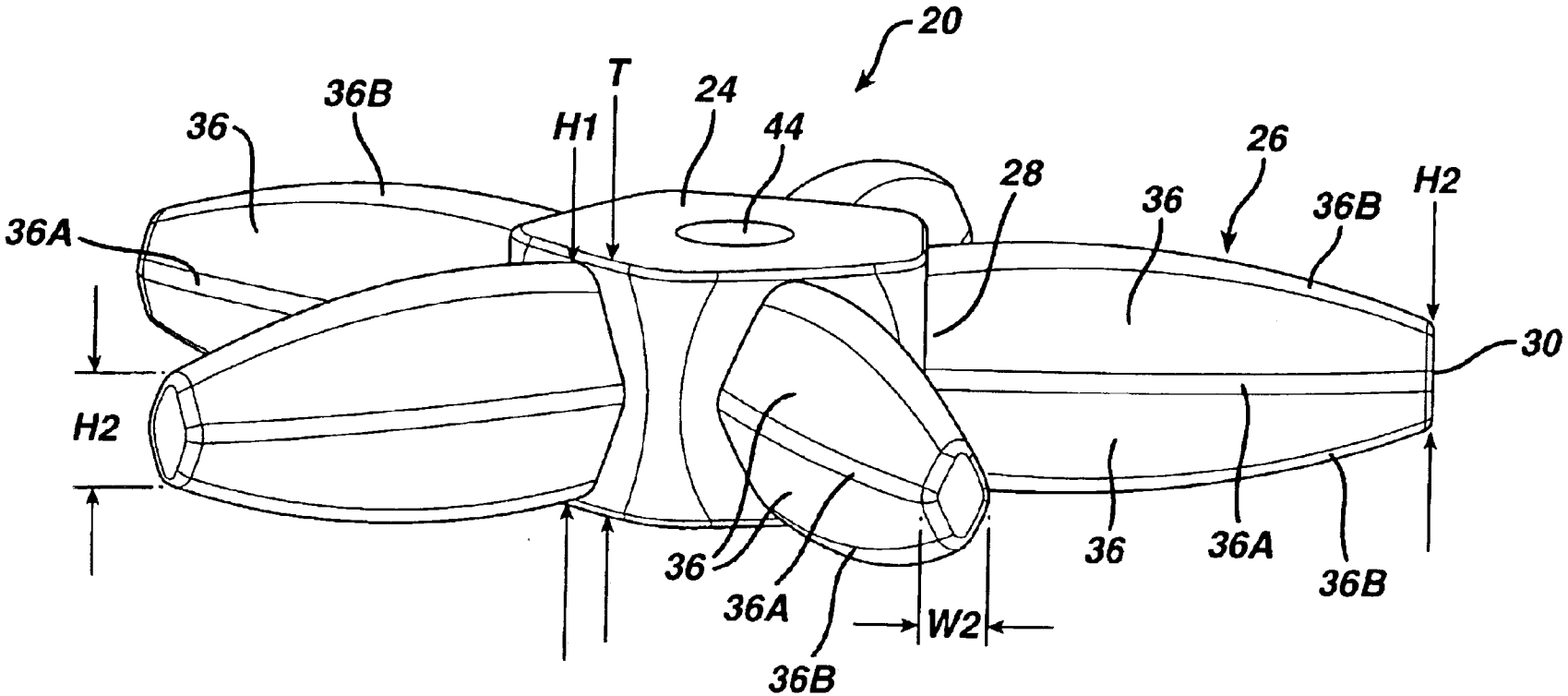
Figure 2B:
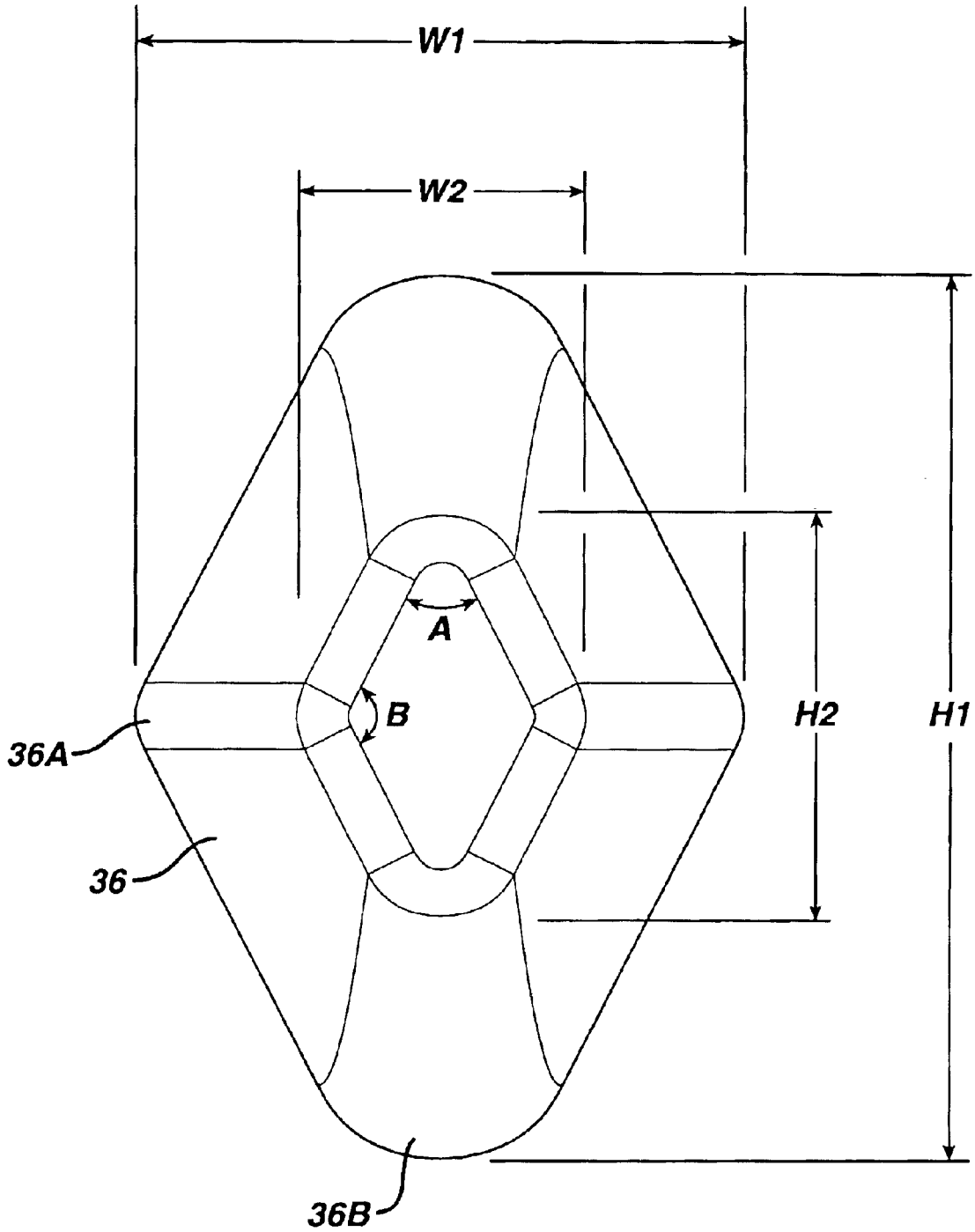
FIG. 2B is a highly enlarged end view of a single member of the rotatable element.

A preferred wheel geometry is shown in FIGS. 2 and 2A. The wheel is generally star-shaped, with five members 26 equally spaced about its circumference. The five members 26 are substantially equal in their dimensions, and the tips 30 of the members 26 define a circle. The radius of the circle (equal to the distance from the center of the central bore 44 to the tip 30) is preferably from about 0.1 to 0.4 inch. Each member 26 is between about 0.150 and 0.200 inches long, more preferably about 0.17–0.19 inches. The effective portion of the member 26 that will penetrate between two adjacent teeth into the interproximal region will vary depending on the final dimensions and the user's particular teeth spacing. As discussed above, the members 26 have a double-taper from the base 28 to the tip 30. The members 26 taper from a height H1 at base 28 to a height H2 at the tip 30. H1 is from about 0.050 to 0.100 inches, more preferably 0.07–0.09 inches. H2 is from about 0.005 to 0.060 inches, more preferably 0.030 to 0.050 inches. The members 26 also taper from a width W1 at base 28 to a narrower width W2 at tip 30. W1 is from about 0.025 to 0.075 inches, more preferably 0.050 to 0.065 inches. W2 is from about 0.005 to 0.050 inches, more preferably 0.015 to 0.035 inches. The wheel has a thickness T of from about 0.050 to 0.200 inches. Referring to FIG. 2B, the cross section of each member 26 defines a generally diamond shape with angle A between about 45° and 60°, more preferably 50° to 55° and an angle B of about 105° to 145°, more preferably 115° to 135°.

The angle between the center point of one of the members 26 and the center point of the adjacent member 26 is necessarily about 72° (i.e., 360° divided by five) for the five-membered wheel shown. It is believed that this angle between members, combined with the preferred dimensions discussed above, provides a desirable spacing between the tips for penetrating the interproximal regions, i.e. a spacing that corresponds approximately to the average spacing of human teeth. By changing the diameter of the wheel, the same spacing can be obtained using more or fewer members. Moreover, if a different spacing is desired this can be obtained in similar manner.

Figure 3:
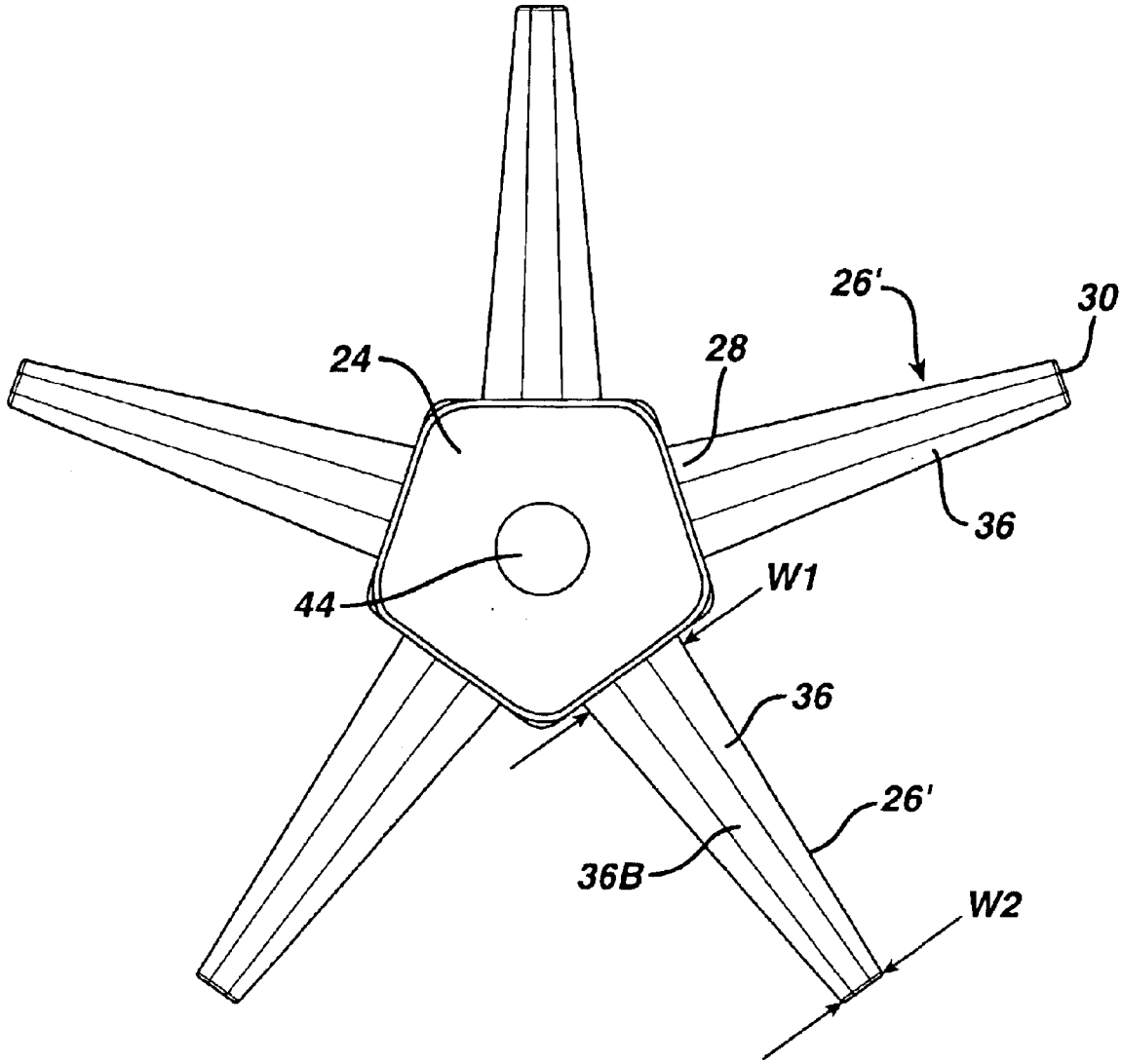
FIG. 3 is a front plan view and FIG. 3A is a perspective view of the rotatable element according to an alternate embodiment of the invention.
Figure 3A:
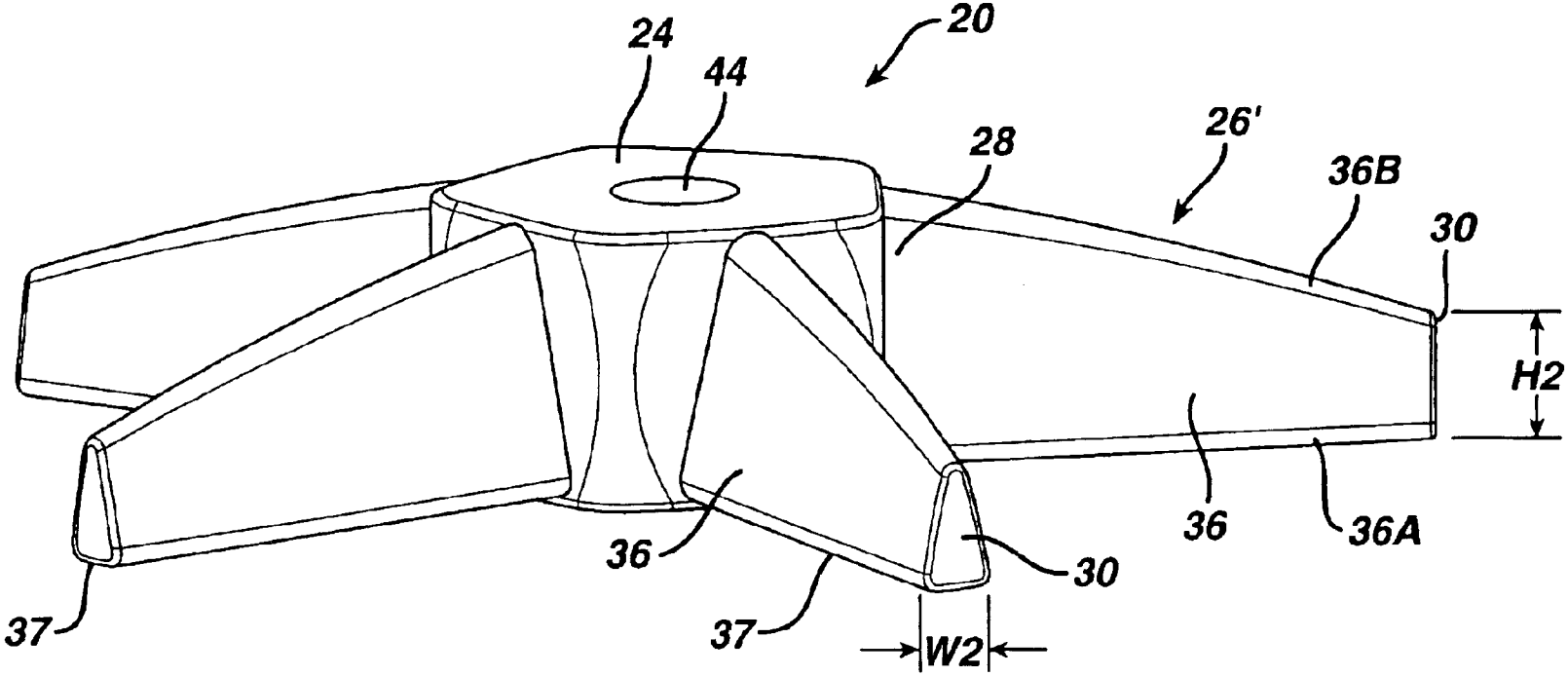
Figure 3B:
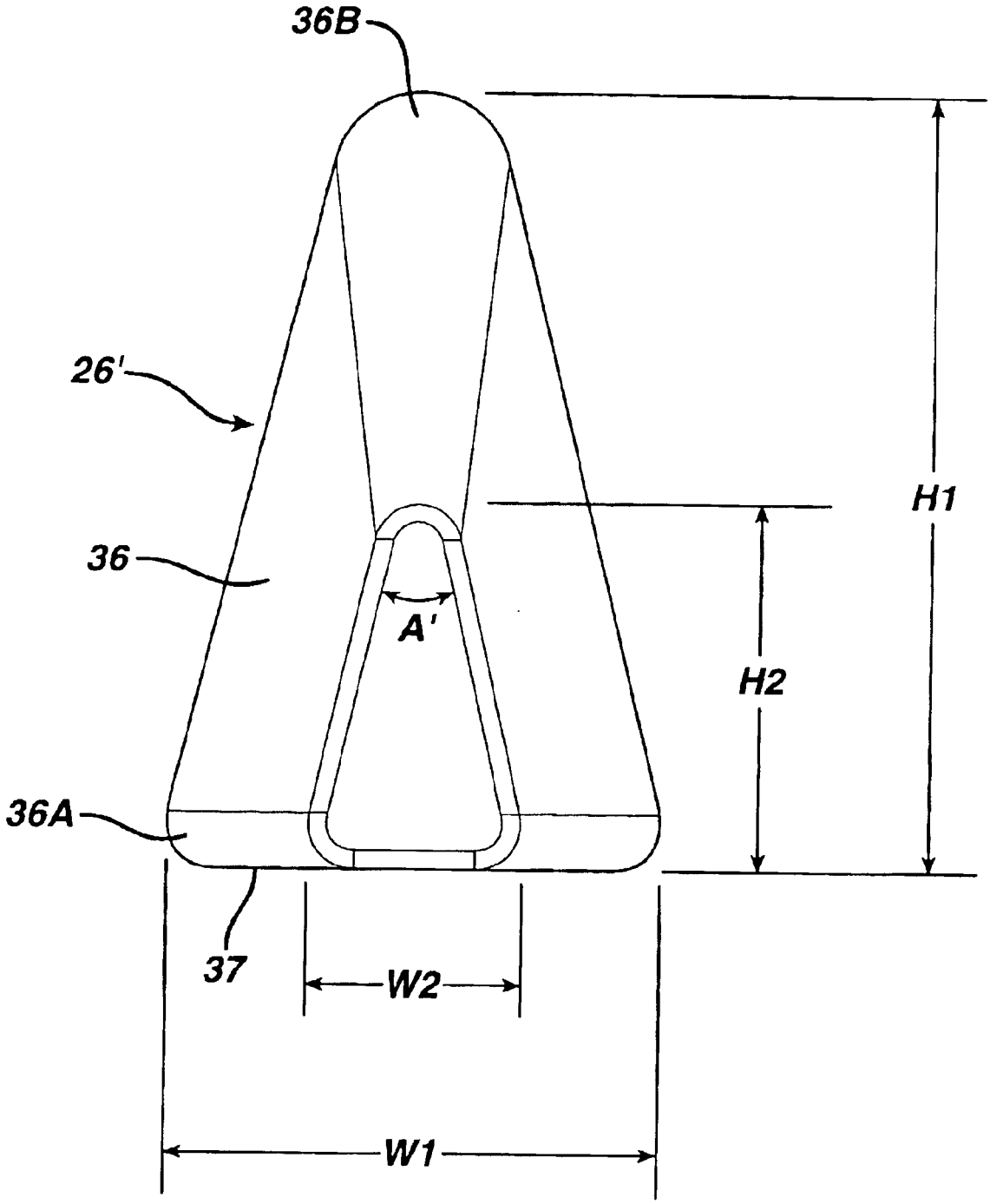
FIG. 3B is a highly enlarged end view of a single member of the rotatable element.

Alternatively, one or more of the members of the wheel may have a substantially triangular cross-section, e.g., member 26' shown in FIGS. 3–3B. Like the member shown in FIGS. 2–2B and discussed above, member 26' includes a double taper, to enable it to wedge between adjacent teeth of a user. The heights H1 and H2 and widths W1 and W2 of member 26', shown in FIG. 2B, will be approximately the same as those specified above for the diamond-shaped member shown in FIGS. 2–2B. The apex angle of the triangle is from about 15 to 35 degrees, more preferably about 20 to 30 degrees (angle A', FIG. 3B). Like the member shown in FIGS. 2–2B, member 26' includes side surfaces 36, which contact the teeth within the interproximal region and rounded interfaces 36A and 36B. Surface 37 will contact the gums within the interproximal region.

The shape of member 26' is particularly suitable for the double-wheeled devices shown in FIGS. 5 and 6 and discussed below, due to the fact that each wheel will only contact the gums on the top of one side of the mouth, and on the bottom on the other side of the mouth. That is, when the user is brushing his or her teeth on the right side of his/her mouth, one wheel will contact the upper gumline and the other wheel will contact the lower gumline. When the user then brushes his/her teeth on the left side of his/her mouth, he/she will rotate the brush 180°, and the wheel that was contacting the upper gumline on the right side of the mouth will now be in contact with the lower gumline on the left side of the mouth. Therefore, only surface 37 will be in contact with the gumline; i.e., the surface 37 mounted facing away, from the head 16.

Figure 4:
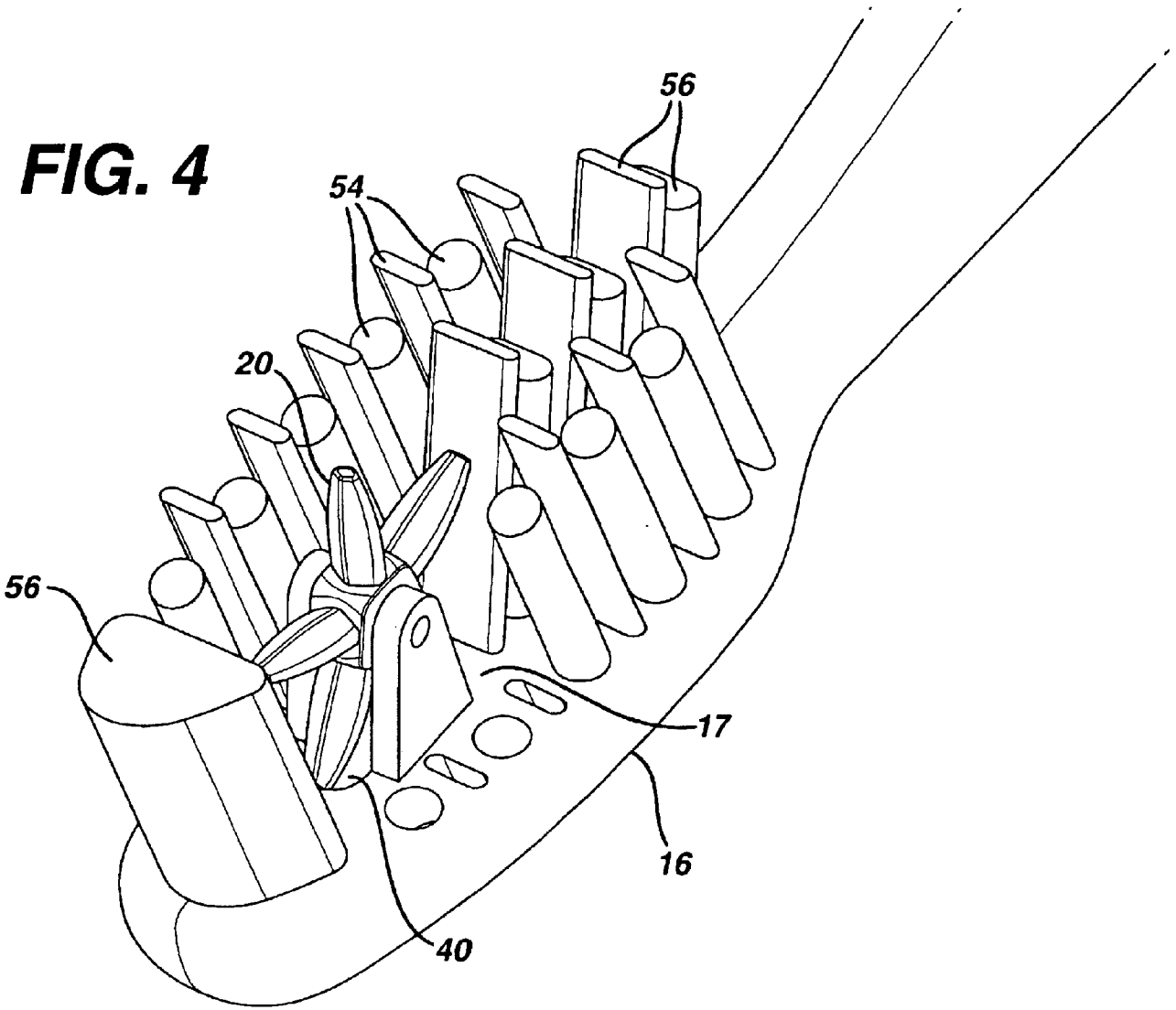
FIG. 4 is an enlarged detail view of an oral brush head according to an alternate embodiment of the invention.

As shown in FIG. 4, the wheel 20 may be positioned in the center of the brush, rather than at the front, as shown in FIGS. 1–1A. Positioning the wheel 20 near the center would allow bristles 54 and 56 mounted closer to the end of the head 16 to surface clean the back teeth. The head 16 includes a channel or well 40 to allow the wheel 20 to rotate freely.

Figure 5:
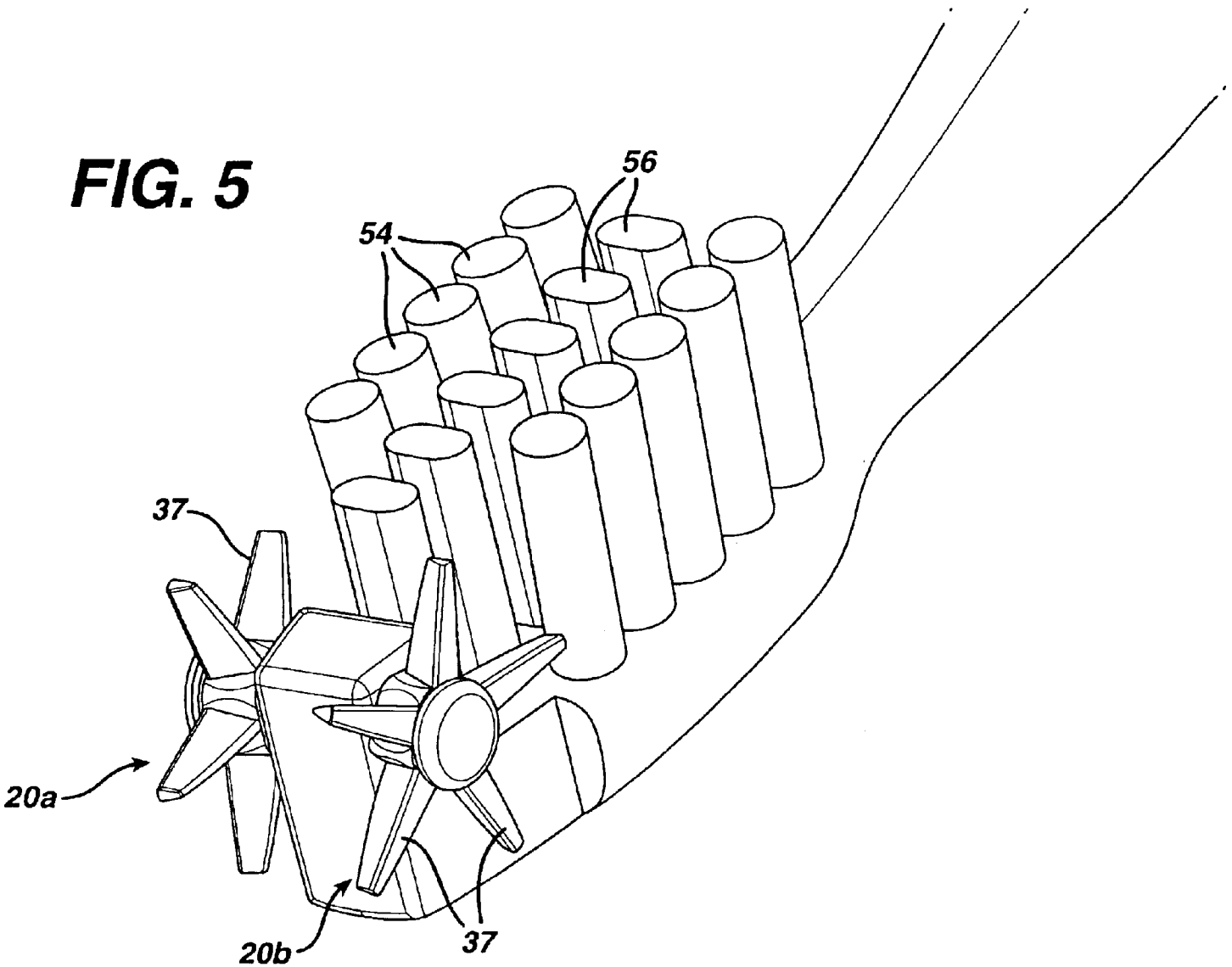
FIGS. 5 and 6 are enlarged detail perspective views of the heads of oral brushes according to alternate embodiments of the invention.
Figure 5A:
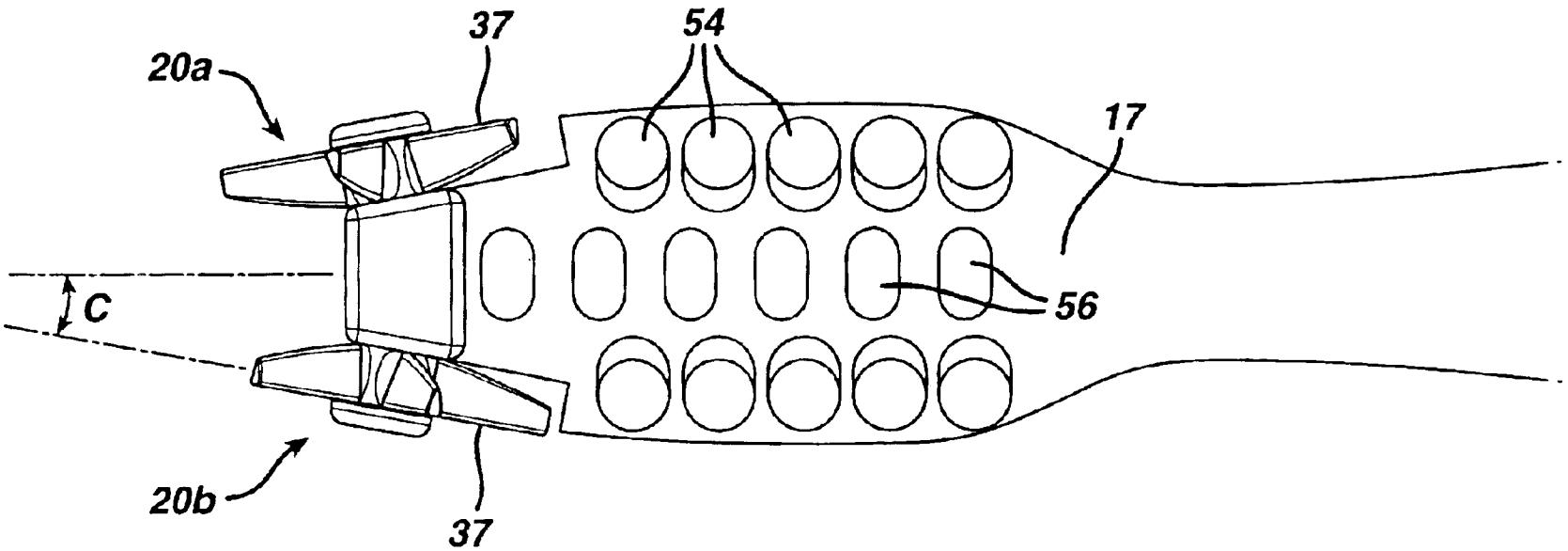
FIG. 5A is a top view of the oral brush shown in FIG. 5.

An alternate embodiment of the invention is shown in FIG. 5. In this embodiment, the oral brush 10 is provided with two wheels 20*a*, 20*b*. Wheels 20*a* and 20*b* are mounted on opposite sides of the brush head, and "toe-in" towards each other, i.e., their axes of rotation are not collinear. This arrangement has been found to facilitate penetration of the tips into the interproximal region when the oral brush is used on the inside surfaces of the teeth. The axes of rotation of the wheels 20*a*, 20*b* together define a horizontal plane that is substantially parallel to the top surface 17 of the head 16. The angle C that is defined by the "toeing-in" of the wheels 20*a*, 20*b*, shown in FIG. 5A, is from about 0 to 45 degrees. Further, the axes of rotation of the wheels 20*a*, 20*b* may be angled with respect to the top surface 17 of the head 16 (not shown). This arrangement can also be combined with the "toe-in" feature to form a compound angle with respect to the top surface 17 of the head 16.

Figure 6:
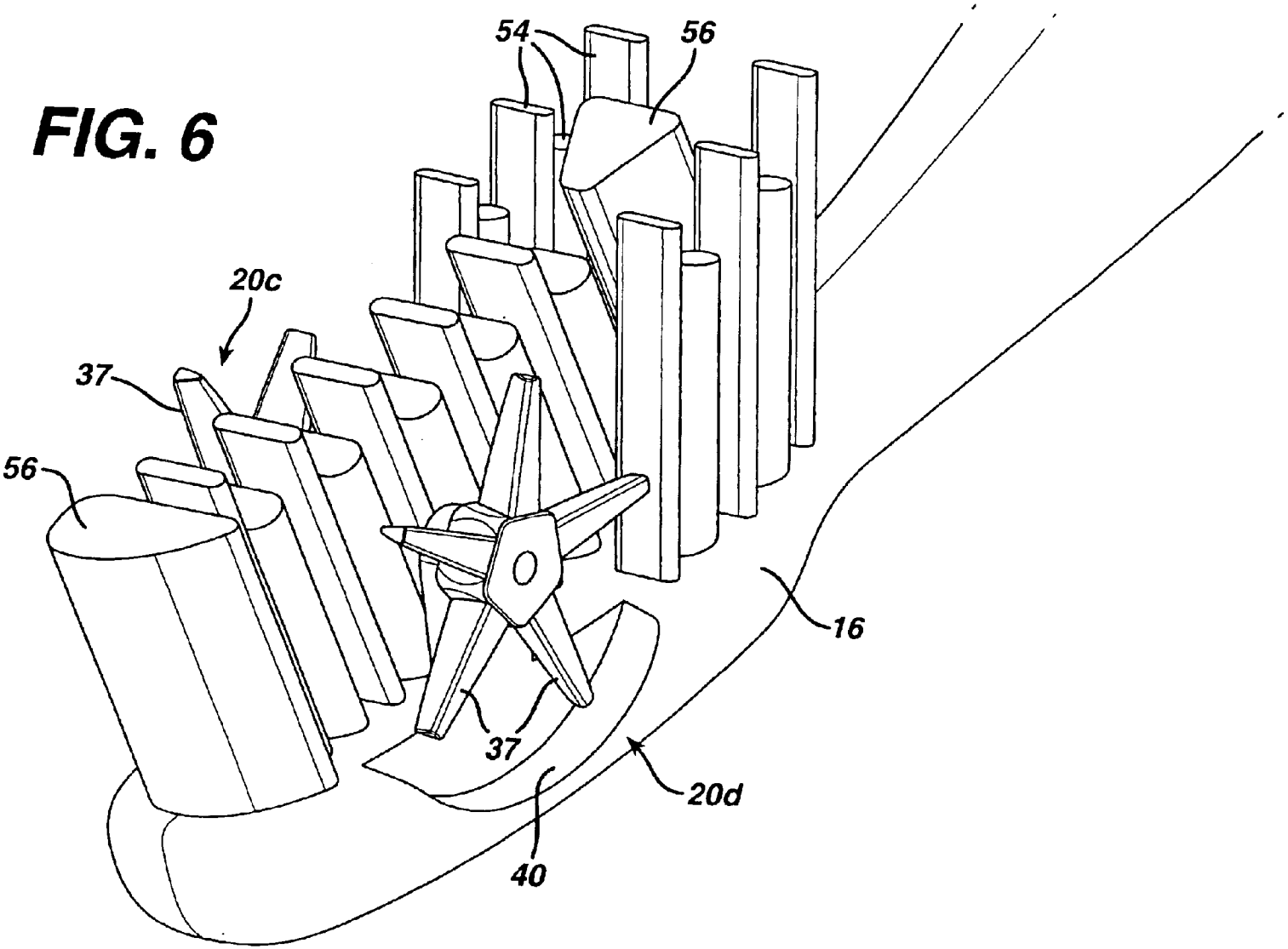

The oral brush generally also includes a plurality of tooth cleansing elements 54 extending from the top surface 17 of head 16, behind the wheels, as shown in FIGS. 4–6. Tooth cleansing elements 54 include bristle tufts constructed to clean along the gumline. The oral brush also includes a central row of bristle tufts 56 constructed to clean the flat surfaces of the teeth.

FIG. 6 shows an alternate embodiment utilizing two rotating wheels 20*c* and 20*d* mounted on opposite sides of the brush head 16, located approximately midpoint of the head 16. Again, these rotating wheels 20*c* and 20*d* may be mounted such that their axes of rotation are either collinear or non-collinear. Further, their axes of rotation can be oriented such that the wheels 20*c* and 20*d* are angled with respect to the top surface 17 of the head 16, as opposed to parallel to the top surface 17.

Figure 7:
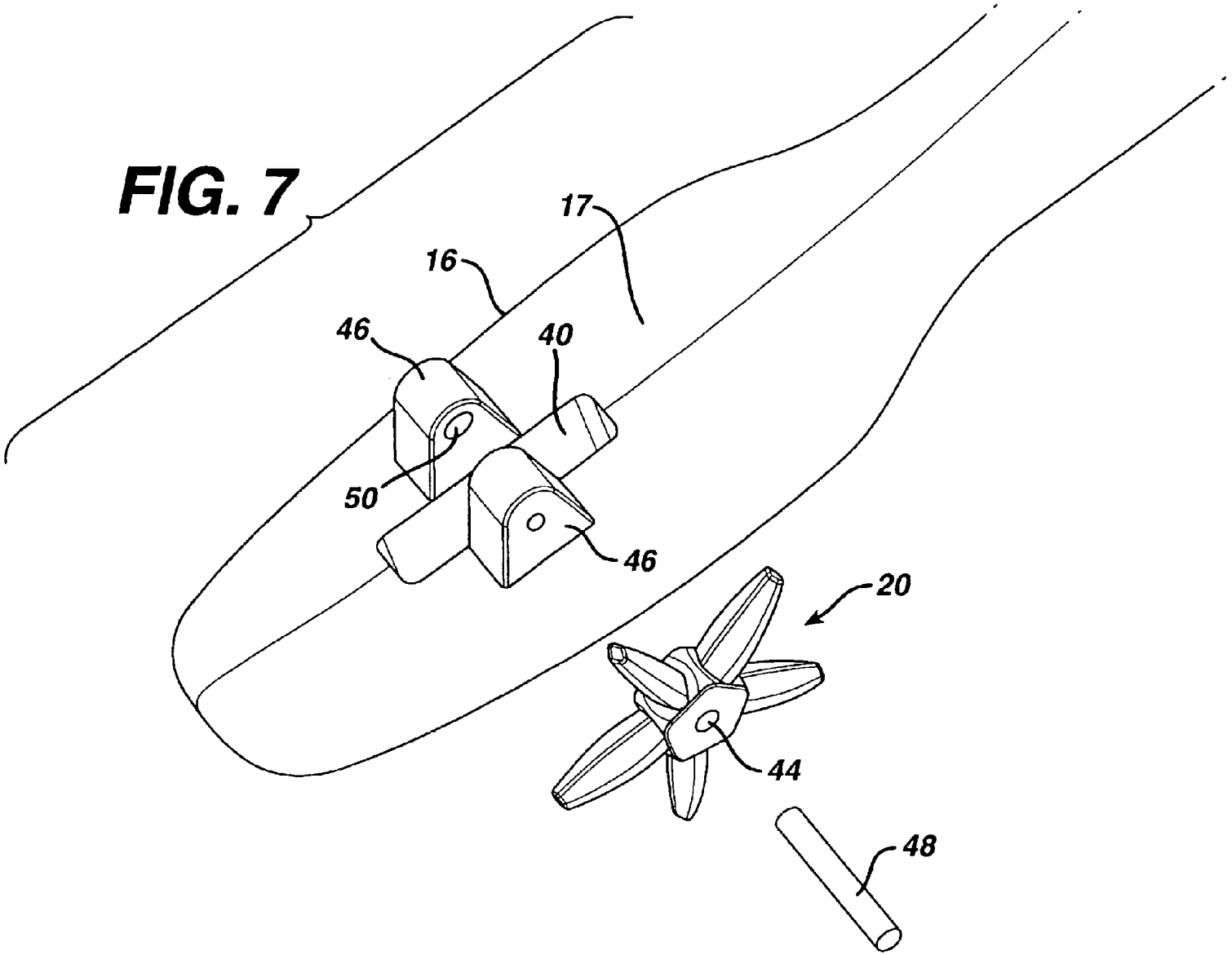
FIG. 7 is an exploded view of an oral brush according to one embodiment of the invention.

One suitable technique for mounting the wheel 20 on the oral brush 10 is shown in FIG. 7. The wheel 20 is placed between supports 46, and pin 48 is inserted through apertures 50 and central bore 44 of wheel 20. Many other techniques can be used, provided that the wheel is securely fastened to the oral brush.

Suitable materials for the wheel 20 include those which are safe for use in the oral cavity and which have suitable mechanical properties. The material used to form wheel 20 is preferably relatively soft and flexible, to avoid user discomfort and to allow the tips to flex during brushing to better penetrate the interproximal region. Preferably, the tip material has a durometer reading of from about 25 to 85 Shore A, more preferably about 40 to 85 Shore A and most preferably about 55 to 75 Shore A. To obtain these properties, the tips 30 are preferably formed of a thermoplastic elastomer. Suitable thermoplastic elastomers include, e.g., KRATON rubber-based block copolymers such as DYNAFLEX G2701 and DYNAFLEX G2755 polymers, commercially available from GLS Corporation, Cary, Ill. The tips 30 can be co-molded with the rest of the wheel, allowing the rest of the wheel to be formed of a different material. In this case, the tips can be formed of a relatively softer material. Suitable tip materials include KRATON rubber-based block copolymers having a hardness of about 70–90 Shore A, e.g., DYNAFLEX G2780 polymer.

Other embodiments are within the claims.

For example, while the invention has been described above in the context of an oral brush having tooth cleansing elements, e.g., tufts of bristles, the rotatable element can also be mounted on an oral device that does not include tooth cleaning elements. Such an oral device can be used to clean and massage the gums and interproximal region, with a conventional toothbrush being used separately to clean the teeth. Further, the rotatable element can be mounted on an oral device, located on the distal end of the handle, opposite the end containing the head and cleansing elements.

Moreover, while the rotatable element is preferably capable of 360° rotation, in some cases it may be desirable to limit the rotation of the rotatable element to less than 360°.

Additionally, the oral brush may include more than two wheels.

Alternatively, the members 26 may be formed of a plurality of bristles that are mounted as a diamond-shaped or wedge-shaped cross-section and trimmed to a double-taper as described above. The bristles may be trimmed to the desired shape after mounting on the hub, or bristles having the desired relative lengths can be mounted on the hub.

What is claimed is:

1. An oral care device comprising:

a body having a head shaped for insertion into the oral cavity, and a rotatable element mounted on the head, the rotatable element including a central portion and a plurality of protrusions extending radially from the central portion, each protrusion generally being diamond shaped or triangular-shaped in cross section and having a polygonal cross-section tapering from a relatively wide base to a relatively narrow tip, wherein each side of the polygon become shorter as the protrusion tapers.

2. The oral care device of claim 1 further comprising tooth cleansing elements extending from a top surface of the head.

3. The oral care device of claim 2 wherein the tooth cleansing elements are selected from bristles, fins and elongated elastomeric members.

4. The oral care device of claim 1 wherein the rotatable element is mounted to rotate about an axis of rotation that is substantially parallel to the top surface of the head.

5. The oral care device of claim 1 wherein the head includes a slot positioned to allow the rotatable element to rotate freely.

6. The oral care device of claim 1 wherein the dimensions of the rotatable element, and the number of protrusions, are selected so that the tips are circumferentially spaced at intervals that correspond approximately to the average spacing of human teeth.

7. The oral care device of claim 1 wherein the protrusions are shaped to wedge between a user's teeth, resulting in compression of the papilla.

8. The oral care device of claim 1 wherein the protrusions are sized to penetrate into the interproximal space.

9. The oral care device of claim 1 wherein the tips have a maximum width of less than 0.050 inch.

10. The oral care device of claim 1 wherein the tips have a maximum width of from about 0.015 to 0.035 inch.

11. The oral care device of claim 1 wherein the base has a maximum width of less than 0.080 inches.

12. The oral care device of claim 1 wherein the base has a maximum width of from about 0.050 to 0.065 inches.

13. The oral care device of claim 1 wherein the tip has a maximum height of less than 0.060 inches.

14. The oral care device of claim 1 wherein the tip has a maximum height of from about 0.030 to 0.050 inches.

15. The oral care device of claim 1 wherein the base has a maximum height less then 0.100 inches.

16. The oral care device of claim 1 wherein the base has a maximum height from about 0.070 to 0.090 inches.

17. The oral care device of claim 1 wherein the protrusions have a length of from about 0.15 to 0.20 inch.

18. The oral care device of claim 1 wherein the tips are formed of a material having a durometer reading of from about 25 to 85 Shore A.

19. The oral care device of claim 1 wherein the tips are formed of a material having a durometer reading of from about 55 to 75 Shore A.

20. The oral care device of claim 1 wherein the tips are formed of a thermoplastic elastomer.

21. The oral care device of claim 1 comprising 5 protrusions wherein the angle between adjacent protrusions is about 72°.

22. The oral care device of claim 1 further comprising rounded interfaces between the sides of the polygon.

23. The oral care device of claim 1 wherein the length of each protrusion is substantially greater than either the height of the protrusion at the base or the width of the protrusion at the base.

24. An oral brush comprising:

a body having a head that is shaped for insertion into the oral cavity, tooth cleansing elements extending from a top surface of the head, and a rotatable element, mounted on the head, including a central portion and a plurality of protrusions extending radially from the central portion, each protrusion having a double-taper from a base having a width of less than 0.080 inches and a height of less than 0.100 inches to a tip having a width of less than 0.050 inches and a height of less than 0.060, the protrusions being generally diamond-shaped in cross-section to wedge between a user's teeth.

* * * * *